US007909450B2

(12) United States Patent
Yamauchi et al.

(10) Patent No.: US 7,909,450 B2
(45) Date of Patent: Mar. 22, 2011

(54) METHOD FOR CLEANING A NOZZLE OF PRINTING APPARATUS

(75) Inventors: Hiroyuki Yamauchi, Nagoya (JP); Tomoyoshi Yabe, Nagoya (JP)

(73) Assignee: Nichiha Co., Ltd, Nagoya-shi (JP)

( * ) Notice: Subject to any disclaimer, the term of this patent is extended or adjusted under 35 U.S.C. 154(b) by 1028 days.

(21) Appl. No.: 11/699,074

(22) Filed: Jan. 29, 2007

(65) Prior Publication Data

US 2007/0188543 A1 Aug. 16, 2007

Related U.S. Application Data

(60) Provisional application No. 60/762,867, filed on Jan. 30, 2006.

(51) Int. Cl.
*B41J 2/165* (2006.01)

(52) U.S. Cl. ..... 347/102

(58) Field of Classification Search ..... None
See application file for complete search history.

(56) References Cited

U.S. PATENT DOCUMENTS 5,589,858 A * 12/1996 Kadowaki et al. ..... 347/14
2003/0085963 A1* 5/2003 Asakawa et al. ..... 347/70
2004/0021724 A1* 2/2004 Kojima ..... 347/19

* cited by examiner

*Primary Examiner* — Stephen D Meier
*Assistant Examiner* — Alexander C Witkowski
(74) *Attorney, Agent, or Firm* — Edwards Angell Palmer & Dodge LLP

(57) ABSTRACT

In a line type inkjet printer, a method for cleaning a nozzle effectively reducing the occurrence of clogging of nozzle. In a nozzle of a printing apparatus having a fixed print head of line type, the method includes a first process for counting the number of times of non-ink jet work operations of the nozzle in each print head from image data for printing, a second process for operating a period to flush based on the number of times of non-ink jet work operations, and the third process for producing a control signal of printing including the period to flush.

5 Claims, 4 Drawing Sheets

METHOD FOR CLEANING A NOZZLE OF PRINTING APPARATUS

CROSS REFERENCE TO RELATED APPLICATIONS

This application claims the benefit of U.S. Provisional Patent Application Ser. No. 60/762,867, filed Jan. 30, 2006.

BACKGROUND OF THE INVENTION

1. Field of the Invention

The present invention relates to a method for cleaning a nozzle of printing apparatus, and more particularly relates to a method for cleaning a nozzle of line type inkjet printer.

2. Description of the Related Art

In an inkjet printer for color printing, nozzle arrays for ink ejection of each color; Y (yellow) color, M (magenta) color, C (cyan) color, and K (black) color, are provided. The number of times of ink jet work operations of each nozzle differs depending on patterns, hue, and density of a print image to be expressed. Accordingly, in a case of a nozzle whose number of times of ink jet work operations is few, the ink in a nozzle part is left in a stationary state for a long time, the ink is affected by a drying effect as a result of peripheral temperature and the ink agglutinates. As a result, in the worst case, the nozzle may become clogged with ink. Particularly, because the ink is not ejected from the clogged nozzle, a non-printed line may be formed and such a defective state (irreparable state) may extend to a large number of substrates.

In inkjet printers, there are two types of inkjet printers; a serial type and a line type. In the serial type printer, all nozzles provided on a print head move on a main scanning line. Accordingly, it is possible to reduce unevenness of the number of times of ink jet work operations among each nozzle by changing combinations of the nozzles to be used in one printing. For example, in Japanese Unexamined Patent Application Publication No. 2002-240257, a method that a nozzle which does not eject ink at all is detected and in subsequent printing, in order to actively use the nozzle, combinations of nozzles to be used are changed, is disclosed.

On the other hand, in the line type printer, print head of each color is fixed and printing is performed when a substrate passes right under print head of each color. Because each nozzle on a print head of each color is in charge of one print line to be formed on the substrate which passes right under the nozzle, it is not possible to change to another nozzle. Accordingly, depending on a print image to be expressed, the number of times of ink jet work operations of each nozzle is fixed. As a result, unevenness of the number of times of ink jet work operations among each nozzle is not corrected and in the extreme case, a nozzle which does not eject ink at all can exist. In such a case, in the nozzle, the nozzle can become clogged with ink. Accordingly, particularly in the line type printer, it is necessary to frequently clean the nozzle during the processing.

For example, in Japanese Unexamined Patent Application Publication No. 11-078055, a method for cleaning a nozzle of a printer is disclosed. In the method, by using a non-printing period, to all nozzles, operation of flushing in which a printing operation of n dots and a subsequent non-printing operation of m dots are repeated a predetermined number of times is performed.

As described above, in the line type printer, the possibility of clogging a nozzle is much greater than that in the serial type printer. Accordingly, by frequently cleaning the nozzle during the non-printing period, it can be possible to reduce the possibility of the clogging of a nozzle.

In the method for cleaning a nozzle of a printing apparatus in the above patent literature 2, because the same operation of flushing is performed to all nozzles, it may be suitable for a case that the number of times of ink jet work operations among each of the nozzles is relatively even such as the serial type printer. However, in a case that the line type printer is used, when the number of times of ink jet work operations among each of the nozzles is extremely uneven, the ink may be consumed more than necessary for the processing of flushing, the expensive ink is consumed, and it is extremely wasteful.

SUMMARY OF THE INVENTION

Accordingly, it is an object of the present invention to provide a method for cleaning a nozzle capable of effectively reducing the occurrence of clogging of a nozzle without consuming ink more than necessary when the line type inkjet printer is used.

In one aspect of the present invention, a method for cleaning a nozzle for a printing apparatus having a fixed print head of line type, the method for cleaning a nozzle includes a first process for counting the number of times of non-ink jet work operations of a nozzle in each print head from image data for printing, a second process for operating a period to flush based on the number of times of non-ink jet work operations, and a third process for producing control signal of printing including the period to flush.

According to the present invention, in the line type inkjet printer, even if any image is to be printed, it is possible to adequately and effectively reduce the occurrence of clogging of nozzle. Accordingly, it can be possible to greatly increase printing quality without increasing printing costs.

DESCRIPTION OF EXEMPLARY EMBODIMENTS

Hereinafter, a line type inkjet printer according to an embodiment of the present invention is described. In this embodiment, a case that printing is performed on a building board by using the inkjet printer is described. However, the present invention can be applied to print on other substrates than the building board.

Figure 1:
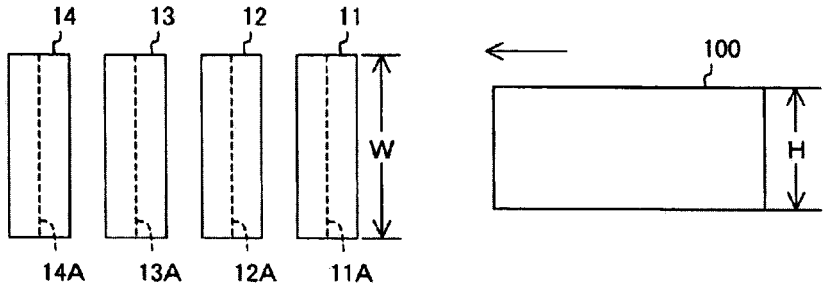
FIG. 1 illustrates a structure of a print head in a printing apparatus according to an embodiment of the present invention.

FIG. 1 schematically illustrates a structure of a print head in a line type inkjet printer. The print head includes four print heads; a print head 11 of Y (yellow) color, a print head 12 of M (magenta) color, a print head 13 of C (cyan) color, and a print head 14 of K (black) color. These print heads are arranged in line along a moving direction of a building board 100 with a predetermined spacing. On an under surface of each print head, nozzle arrays 11A, 12A, 13A, and 14A for ink ejection of each color are respectively provided.

When the building board 100 is moved toward the print heads, first, a printing of Y color is performed. Then, a printing of M color is performed and further printings of C color and K color are performed. A width W of the nozzle array in each print head is wider than a print width H of the building board 100. Accordingly, by passing the building board 100 under each head once, the printing on the surface to be printed (surface design) of the building board 100 is completed. One nozzle on each print head prints on the opposite position on the surface to be printed on the building board 100 which moves right under the nozzle, and when the printing is completed, one print line is formed.

Figure 2:
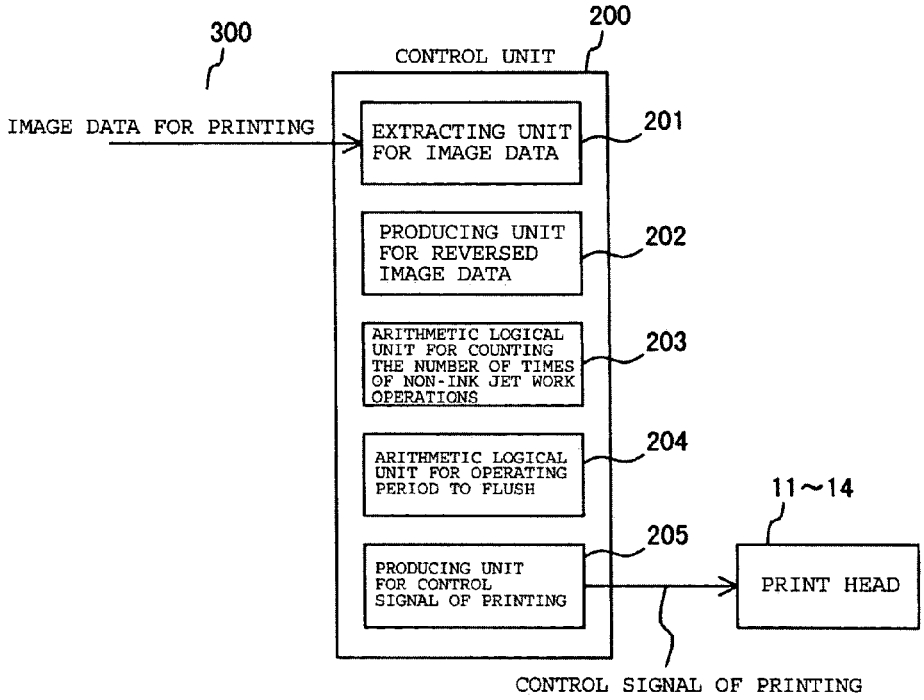
FIG. 2 illustrates a structure of a control unit in the printing apparatus according to an embodiment of the present invention.
Figure 3:
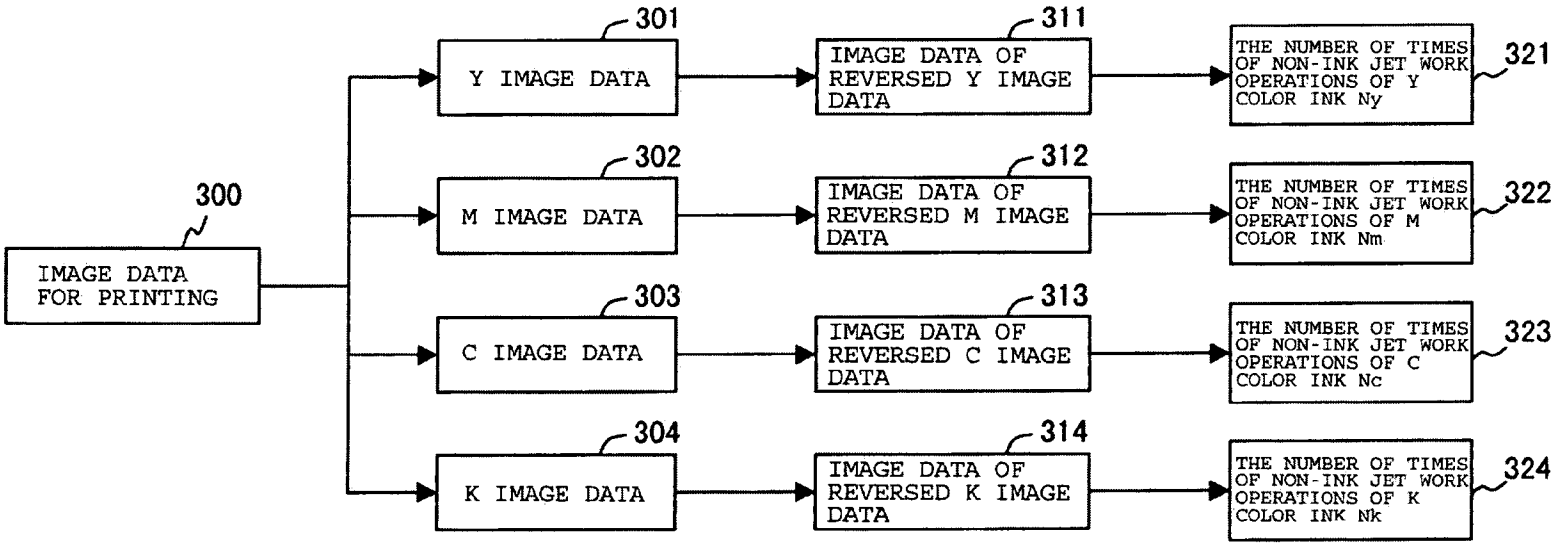
FIG. 3 is a view for explaining a method to produce a control signal of printing of each print head from image data for printing.

With reference to FIGS. 2 and 3, a structure and operation of a control unit of the line type inkjet printer according to an embodiment of the present invention is described. A control unit 200 in this embodiment includes an extracting unit 201 for image data, a producing unit 202 for reversed image data, an arithmetic logical unit 203 for counting the number of times of non-ink jet work operations, an arithmetic logical unit 204 for operating period to flush, and a producing unit 205 for control signal of printing. The control device can be a computer which has a CPU, a RAM, a storage device, etc., and the operation of each part in the control device can be executed by software which is executed by the computer.

In the extracting unit 201 for image data, when image data 300 for printing is input, Y image data 301, M image data 302, C image data 303, and K image data 304 are extracted as shown in FIG. 3. The image data 300 for printing represents a pattern and color of a surface design of a building board and includes a control signal of ink jet for each nozzle in all print heads. The control signal of ink jet is generally an on-off signal which has a predetermined cycle. That is, when ejecting ink, the signal becomes on and when not ejecting ink, the signal becomes off. The Y image data 301 includes a control signal of ink jet of each nozzle in the print head 11 of Y color. Similarly, the M image data 302 includes a control signal of ink jet of each nozzle in the print head 12 of M color. The C image data 303 includes a control signal of ink jet of each nozzle in the print head 13 of C color. The K image data 304 includes a control signal of ink jet of each nozzle in the print head 14 of K color.

It is assumed that the number of on-signals included in the Y image data 301, M image data 302, C image data 303, and K image data 304 is My, Mm, Mc, and Mk, respectively. My, Mm, Mc, and Mk indicate the number of times of ink jet work operations, and the total Mt=My+Mm+Mc+Mk indicates the number of total dots of an image to be printed by the image data 300 for printing.

The producing unit 202 for reversed image data produces image data 311 of reversed Y image data, image data 312 of reversed M image data, image data 313 of reversed C image data, and image data 314 of reversed K image data from the Y image data 301, M image data 302, C image data 303, and K image data 304, respectively. The reversed data is produced by reversing on and off of the original data. If printing is performed by using the reversed data, a reversed image of the image printed by using the original data is printed.

The arithmetic logical unit 203 for counting the number of times of non-ink jet work operations counts the total of the number of times of non-ink jet work operations of all nozzles in each print head. On-signals in each reversed image data mean off-signals in image data, that is, non-ejection of ink. In order to count the number of times of non-ink jet work operations of each print head, on-signals included in each reversed image data are to be counted. It is assumed that the number of on-signals included in the image data 311 of reversed Y image data, image data 312 of reversed M image data, image data 313 of reversed C image data, and image data 314 of reversed K image data are Ny, Nm, Nc, and Nk, respectively. Ny, Nm, Nc, and Nk indicate the number of times of non-ink jet work operations of each print head (in FIG. 3, 321 to 324).

The arithmetic logical unit 204 for operating a period to flush operates a period to flush of each print head based on the number of times of non-ink jet work operations of each print head. Periods to flush of the print heads of four colors, tf1, tf2, tf3, and tf4, are operated based on the number of times of non-ink jet work operations of each print head, Ny, Nm, Nc, and Nk. Accordingly, tf1=tf(Ny), tf2=tf(Nm), tf3=tf(Nc), and tf4=tf(Nk). As the number of times of non-ink jet work operations increases, the possibility of clogging of nozzle increases. Accordingly, to the print head whose number of times of non-ink jet work operations is large, a long period to flush is set and to the print head whose number of times of non-ink jet work operations is small, a short period to flush is set. For example, by multiplying the number of times of non-ink jet work operations of each print head, Ny, Nm, Nc, and Nk, by a predetermined coefficient, the periods to flush tf1, tf2, tf3, and tf4 can be operated. Based on the periods to flush tf1, tf2, tf3, and tf4, data of flushing is produced.

Figure 4:
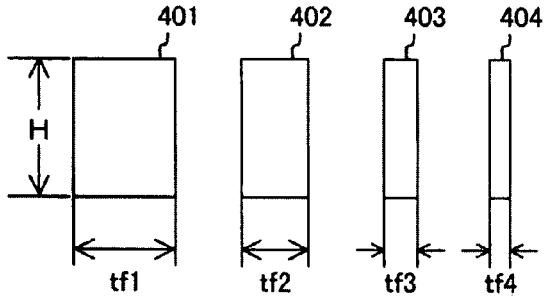
FIG. 4 illustrates an example of data of flushing for cleaning nozzles of each print head.

With reference to FIG. 4, the data of flushing is described. The data of flushing is the data of a color bar of one color of Y color, M color, C color, or K color. The data of a color bar is a signal for continuously ejecting ink without non-jet point. FIG. 4 illustrates an image of one color which is printed by the data of a color bar of one color. The longitudinal size of the data shows a width of flushing of print head and the horizontal size of the data shows a period to flush of the print head. For example, data 401 of flushing for print head of Y color has the same width as the print width H of the building board 100, and has the period to flush tf1. As well as the data 401 of flushing, data 402 of flushing for print head of M color, data 403 of flushing for print head of C color, and data 404 of flushing for print head of K color have the same width as the print width H of the building board 100, respectively, and have the periods to flush tf2, tf3, and tf4, respectively.

The producing unit 205 for control signal of printing produces print instructions to each print head, that is, produces control signals of printing by using the data 401 to 404 of flushing.

Figure 5:
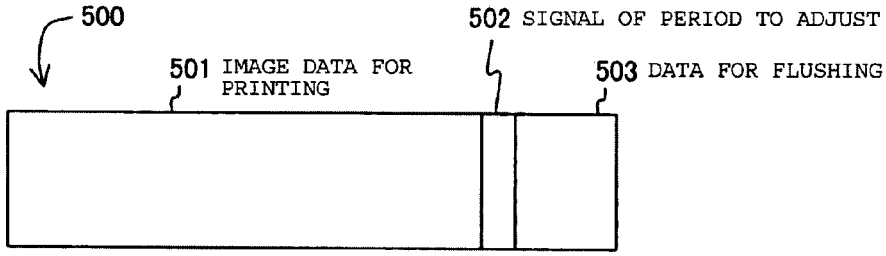
FIG. 5 illustrates an example of a control signal of printing of each print head.

With reference to FIG. 5, the control signal of printing is described. A control signal 500 of printing includes image data 501 for printing, a signal 502 of period to adjust, and data 503 for flushing. Each print head performs printing according to the image data 501 for printing, stops the printing in response to the next signal 502 of period to adjust, and performs flushing according to the next data 503 for flushing.

The control signal of printing in which such data of flushing is inserted is provided to print heads every printing of a predetermined number of boards.

In this embodiment, because the data of flushing is included in the data to control printing, cleaning the nozzle is performed without detecting the back end of the building board, that is, the printing end point.

As described above, in the present invention, because each print head performs flushing corresponding to the number of times of non-ink jet work operations of each print head, Ny, Nm, Nc, and Nk, even if a nozzle exists whose number of times of non-ink jet work operations is, it is possible to reduce the clogging of nozzle with ink.

Figure 6:
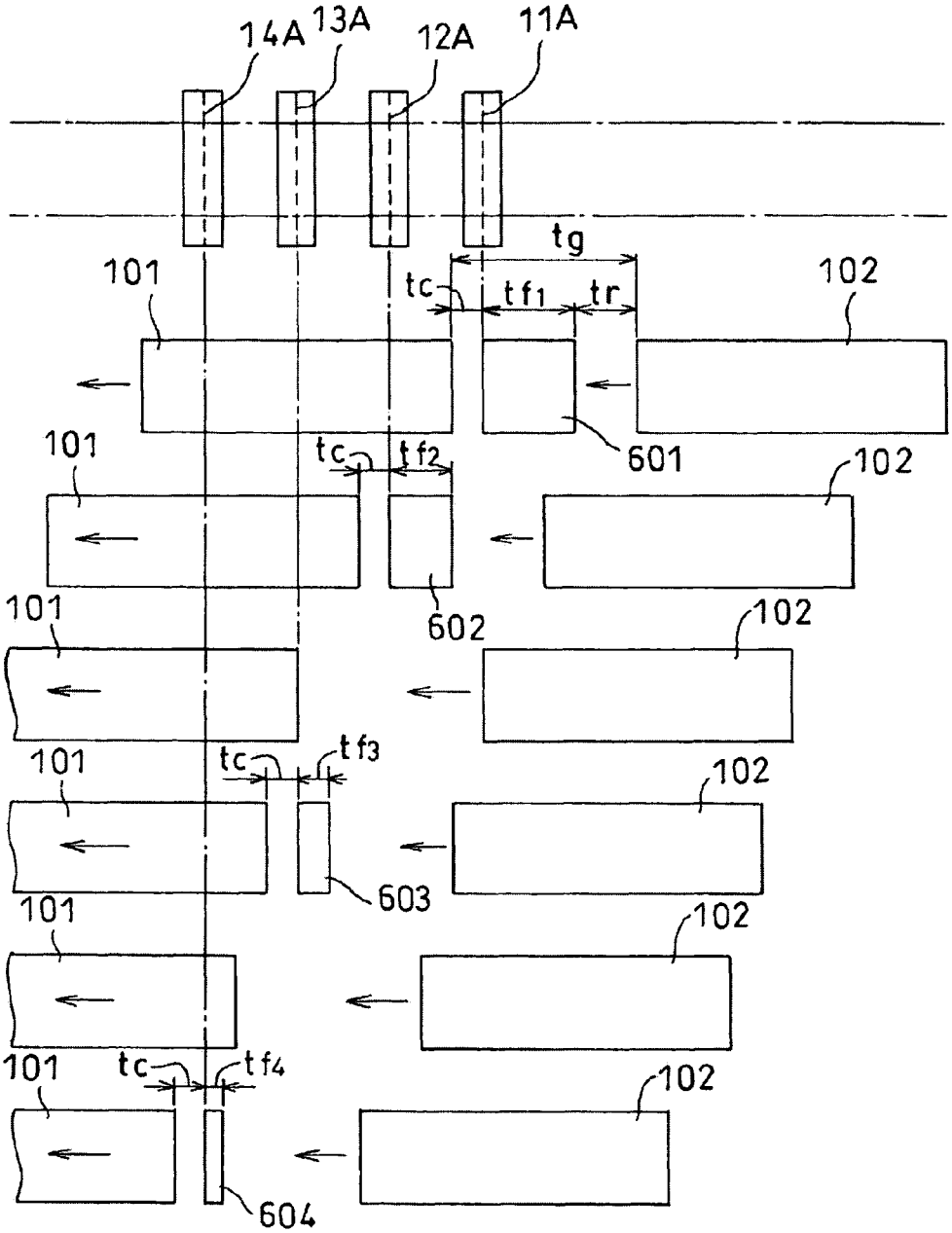
FIG. 6 is a view for explaining an operation for cleaning nozzle according to an embodiment of the present invention.

With reference to FIG. 6, a case in which when printing on a building board by using the printing apparatus according to the present invention, the flushing for cleaning the nozzle according to the present invention is performed is described. After the time point that the back end of a previous building board 101 passed right under the nozzle array 11A of the print head 11 of Y color, that is, after the time point that printing on the previous building board 101 by the Y color finished, at the time point that the period of adjustment tc has passed, flushing 601 of print head 11 of Y color is performed. The period to flush is tf1. After the flushing of the print head 11 of Y color finished, when time tr passes, printing on a next building board 102 by Y color is started.

If it is assumed that the time from the back end of the previous building board 101 passed the nozzle array 11A of Y color to the time the front end of the next building board 102 arrives to the nozzle array 11A of Y color is tg, tg=G/v. In this case, the distance between the building board 101 and the building board 102 is G, and the moving velocity of the building board is v. Further, the period of adjustment is tc=ΔL/v. In this case, ΔL is the distance that the building board 101 moves during the time from the back end of the building board 101 passed right under the nozzle array 11A until the flushing is started.

Then, tg=tc+tf1+tr. The sum of the period of adjustment tc and the period to flush tf, that is, tc+tf, should be smaller than the moving time tg.

Similarly, after the time point that printing on the previous building board 101 by M color finished, at the time point that the period of adjustment tc=ΔL/v has passed, flushing 602 of print head 12 of M color is performed. The period to flush of the print head 12 of M color is tf2. After the time point that the printing on the previous building board 101 by C color is finished and the period of adjustment tc has passed, flushing 603 of print head 13 of C color is performed. The period to flush of the print head 13 of C color is tf3. Finally, after the time point that the printing on the previous building board 101 by K color is finished and the period of adjustment tc has passed, flushing 604 of print head 14 of K color is performed. The period to flush of the print head 14 of K color is tf4. Right under each print head, an ink receiving part (not shown) is provided to collect the flushed ink by using the receiving part and the collected ink is returned to an ink tank.

While the present invention has been described with reference to exemplary embodiment, it is to be understood that the invention is not limited to the disclosed exemplary embodiment and various modifications of the present invention can be made without departing from the spirit and scope of the present invention as defined in the appended claims.

DRAWINGS

FIG. 2

300: IMAGE DATA FOR PRINTING
200: CONTROL UNIT
201: EXTRACTING UNIT FOR IMAGE DATA
202: PRODUCING UNIT FOR REVERSED IMAGE DATA
203: ARITHMETIC LOGICAL UNIT FOR COUNTING THE NUMBER OF TIMES OF NON-INK JET WORK OPERATIONS
204: ARITHMETIC LOGICAL UNIT FOR OPERATING PERIOD TO FLUSH
205: PRODUCING UNIT FOR CONTROL SIGNAL OF PRINTING
印刷制御信号: CONTROL SIGNAL OF PRINTING
11~14: PRINT HEAD

FIG. 3

300: IMAGE DATA FOR PRINTING
301: Y IMAGE DATA
302: M IMAGE DATA
303: C IMAGE DATA
304: K IMAGE DATA
311: IMAGE DATA OF REVERSED Y IMAGE DATA
312: IMAGE DATA OF REVERSED M IMAGE DATA
313: IMAGE DATA OF REVERSED C IMAGE DATA
314: IMAGE DATA OF REVERSED K IMAGE DATA
321: THE NUMBER OF TIMES OF NON-INK JET WORK OPERATIONS OF Y COLOR INK Ny
322: THE NUMBER OF TIMES OF NON-INK JET WORK OPERATIONS OF M COLOR INK Nm
323: THE NUMBER OF TIMES OF NON-INK JET WORK OPERATIONS OF C COLOR INK Nc
324: THE NUMBER OF TIMES OF NON-INK JET WORK OPERATIONS OF K COLOR INK Nk

FIG. 5

501: IMAGE DATA FOR PRINTING
502: SIGNAL OF PERIOD TO ADJUST
503: DATA FOR FLUSHING

What is claimed is:

1. A method for cleaning a nozzle of a printing apparatus having a fixed print head of line type, comprising:

a first process for counting the number of times of non-ink jet work operations of a nozzle in each print head from image data for printing;

a second process for operating a period to flush based on the number of times of non-ink jet work operations; and a third process for producing a control signal of printing including image data for printing on a substrate, a period of adjustment from a time point when the printing is completed to a time point when a flushing is started, and the period to flush every predetermined number of times of printing.

2. The method for cleaning a nozzle of a printing apparatus according to claim 1, wherein the first process includes:

a first step of extracting the number of times of ink jet work operations of the nozzle in each print head from image data for printing; and a second step of counting the number of times of non-ink jet work operations of the nozzle from the number of times of ink jet work operations of nozzle.

3. A computer-readable program for directing a printing apparatus to execute the method as defined in claim 2 through a computer.

4. A computer-readable program for directing a printing apparatus to execute the method as defined in claim 1 through a computer.

5. A printing apparatus for printing on a building board, comprising:

a fixed print head of line type; and control unit for producing a data to control printing to be provided to the print head, wherein the control unit includes an arithmetic logical unit for counting the number of times of non-ink jet work operations of a nozzle in each print head from image data for printing, an arithmetic logical unit for operating a period to flush based on the number of times of non-ink jet work operations, and a producing unit for producing a control signal of printing including image data for printing on a substrate, a period of adjustment from a time point when the printing is completed to a time point when a flushing is started, and the period to flush every redetermined number of times of printing.

* * * * *